United States Patent [19]

de Laforcade

[11] Patent Number: 5,007,563

[45] Date of Patent: Apr. 16, 1991

[54] DISPENSING HEAD FOR AN ADDITIVE PRODUCT FOR MOUNTING ON A RECEPTACLE AND A RECEPTACLE EQUIPPED WITH SUCH A HEAD

[75] Inventor: Vincent de Laforcade, Clamart, France

[73] Assignee: L'Oreal, Paris, France

[21] Appl. No.: 432,854

[22] Filed: Nov. 7, 1989

[30] Foreign Application Priority Data

Nov. 9, 1988 [FR] France ..... 8814644

[51] Int. Cl.[5] ..... B67D 5/56; B65D 25/40

[52] U.S. Cl. ..... 222/145; 222/509; 222/525

[58] Field of Search ..... 222/506–509, 222/522, 525, 136, 137, 145, 542

[56] References Cited

U.S. PATENT DOCUMENTS

| | | | |
|---|---|---|---|
| 2,455,572 | 12/1948 | Evans | 222/145 X |
| 2,914,220 | 11/1959 | Marraffino | 222/145 |
| 3,002,658 | 10/1961 | Sayda | 222/145 X |
| 3,042,263 | 11/1959 | Gallo, Sr. | 222/94 |
| 3,135,428 | 6/1964 | Gallo, Sr. | 222/145 X |
| 3,182,860 | 5/1965 | Gallo, Sr. | 222/136 |
| 3,311,263 | 6/1965 | Harmon | 222/94 |
| 3,747,804 | 7/1973 | Raaf et al. | 222/145 X |

FOREIGN PATENT DOCUMENTS

| | | |
|---|---|---|
| 1341226 | 12/1962 | France . |
| 1115583 | 4/1966 | United Kingdom . |

*Primary Examiner*—Michael S. Huppert
*Assistant Examiner*—Kenneth DeRosa
*Attorney, Agent, or Firm*—Cushman, Darby & Cushman

[57] ABSTRACT

A dispensing head for container having an outlet nozzle includes a coupling member for fitting on the nozzle and is provided with a central conduit, a chamber for an additive product surrounding the central conduit with the chamber having at its base an annular opening to the central conduit; a tube is slidably disposed in the central conduit and has at one end adjacent the coupling member openings so that when the head is mounted on the nozzle the tube will be moved from a storage position, where the opening of the chamber to the central conduit is closed, to another position where the openings of the tube establish communication between the chamber's opening and the central conduit; the end of the chamber remote from the nozzle has a plurality of openings to permit dispensing of the additive with the main product.

12 Claims, 2 Drawing Sheets

DISPENSING HEAD FOR AN ADDITIVE PRODUCT FOR MOUNTING ON A RECEPTACLE AND A RECEPTACLE EQUIPPED WITH SUCH A HEAD

FIELD OF THE INVENTION

The present invention relates to a dispensing head for a product which head is intended to be mounted on the outlet of a receptacle containing the product of a type which is generally delivered under the form of an aerosol foam or a paste, the head being generally of the type which includes a central conduit for passage of the product provided from the receptacle and a chamber surrounding the central conduit and containing the additive with means of delivering of the additive being provided adjacent the extremity of the chamber opposite the container with the means of entry of the product into the chamber being provided in order to permit the product to expel the additive from the chamber in order to form a mixture of the additive with the product delivered from the outlet of the central conduit.

BACKGROUND OF THE INVENTION

A dispensing head of this type is known for example from French Patent Application 1341226 wherein there is provided the supply to the product of the container of an additive such as a coloring agent or a perfume at the point or moment of use. This avoids prolonged contact during storage between the additive and the main product and undesirable alteration of these components.

The storage of the dispensing head sometimes poses problems concerning the conservation or preservation of the additive and its protection from the ambient atmosphere. Moreover, it is desirable that the mounting of the dispensing head on the receptacle be effected simply and rapidly.

SUMMARY OF THE INVENTION

The present invention has for an object especially the provision of a dispensing head of the type described above in which, during storage, the chamber containing the additive is well isolated from the atmosphere, with the head readily permitting a rapid mounting on the receptacle with a simple operation.

According to the invention, a dispensing head for an additive of the type described above is characterized by the fact that the central conduit of the head includes a closed portion at the extremity of the head remote from the point of attachment to the container and formed by a cylindrical wall which terminates at a certain distance from a base wall of the head and that a sleeve or tube is slidably mounted in and relative to the central conduit, the tube including, at its extremity which faces towards the container, openings in the wall thereof, the structure being such that in a storage condition, the tube engages only to a minimum extent with a portion of the central conduit and the openings of the tube do not communicate with the annular chamber which is thereby isolated, whereas, in a second position of operation, the tube is displaced by sliding relative to the section of the central conduit wherein the openings are placed in communication with the central conduit and the annular chamber.

Preferably, the tube is slidably mounted on the interior of a portion of the central conduit.

Advantageously, the dispensing head includes, on the side facing the receptacle, an exterior wall forming a cylindrical coupling of which the interior surface is capable of closing the openings of the tube when placed in the storage position; the cylindrical coupling is provided, on the side opposite that facing the container, with a flared conical portion which is joined to the exterior cylindrical wall of the dispensing head.

The openings provided in the tube may be constituted by longitudinal slots which are opened on the end of the tube which faces towards the container in use.

Generally, the dispensing head is intended to be mounted on the container's outlet nozzle which has a cylindrical shape; the coupling of the dispensing head is designed to engage with a smooth frictional contact on the nozzle and the sliding tube has an exterior diameter substantially equal to that of the outlet nozzle so that the placement of the dispensing head on the container nozzle causes the sliding of the tube under the action of contact with the nozzle.

Advantageously, the upper extremity of the central conduit is extended by a flaring conical portion on the side opposite the attachment to the container and thereby especially permits the product from the receptacle to expand during dispensing.

The conical portion is preferably surrounded at its exterior end with a peripheral rim or crown which closes the annular chamber, the rim or crown being provided with a plurality of exit passages constituting means for delivery of the additive.

A plurality of walls, radially and angularly spaced apart are advantageously provided in the additive chamber surrounding the central conduit.

The correspondence of the diameter of the central conduit to the sum of the diameters of the exit passages for the additive is chosen according to the desired length and size for the ribbons formed in the dispensed product and according to the viscosity of the additive.

For storage, the dispensing head is closed at its end spaced from that intended to be mounted on the container by a closure and in particular a thermo-film or adhesive cover. The opposite extremity of the chamber of the dispensing head is closed by the tube placed in a storage position; if the case arises, this closure is able to be completed by another film cover on the corresponding extremity of the dispensing head.

The invention also provides a container for a product of the type delivered generally in the form of a foam or a paste characterized by the fact that the container is equipped with a dispensing head such as described above.

The invention consists, together with the description that follows, in a number of other arrangements which will be described in detail herein together with a specific example described with reference to the accompanying drawings but which is not limiting in any way.

DETAILED DESCRIPTION OF THE INVENTION

Figure 1:
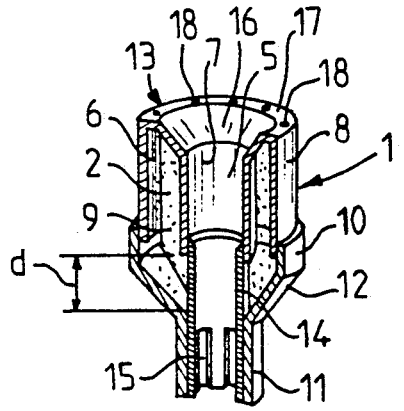
FIG. 1 shows a perspective view with parts in section of a dispensing head of the present invention in a storage condition before mounting on a container.

With reference now to FIG. 1 of the drawings, there is shown a dispensing head 1 for an additive 2, the head being intended to be mounted on the outlet 3 of a container 4 for a product. In the present example, the container 4 is a pressurized container provided to deliver, when the user presses on a valve, an aerosol foam which is dispensed from the outlet 3. It is clear however that the dispensing head 1 is able to be connected on the outlet of receptacles of other types, for example, the exit of a tube having a deformable wall, containing a paste, in particular, a dental paste.

Figure 4:
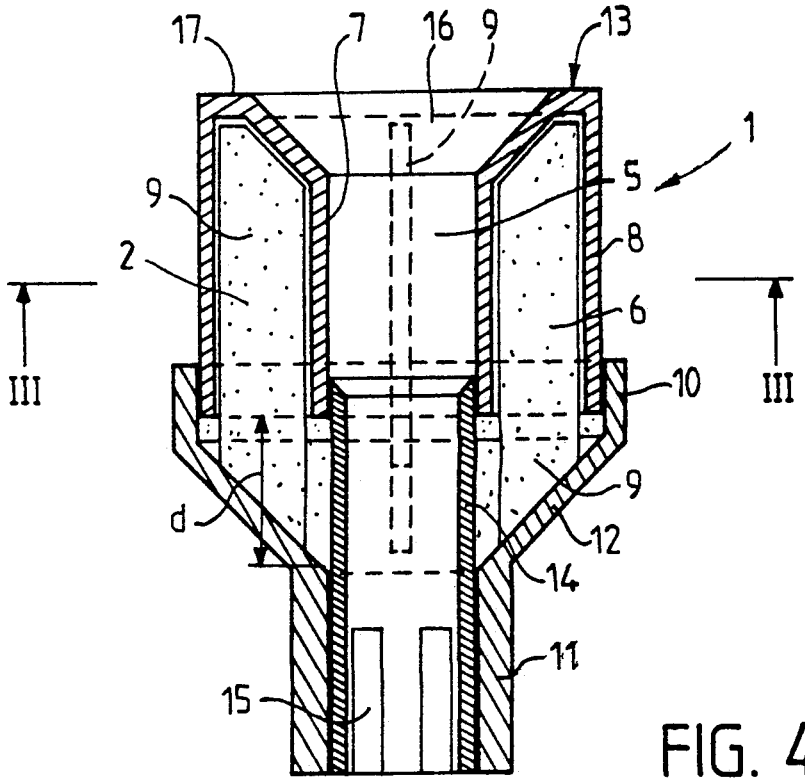
FIG. 4, is a view along lines IV—IV of FIG. 3.

The head 1 includes a central conduit 5 for the passage of the product provided in the container 4 and an annular chamber 6 surrounding the central conduit 5 and a cylindrical wall 7 defining the conduit. The chamber 6 contains the additive 2 and is enclosed, on the outside by, by a cylindrical wall 8 which is coaxial with the wall 7. The radial partitions 9, between the wall 8 and the wall 7, are regularly spaced in the annular chamber 6 in a manner to compartmentalize chamber 6 in a peripheral sense. The exterior cylindrical wall 8 is engaged tightly and is fixed, especially by welding, in a collar 10 which is integrally formed with or joined to a cylindrical coupler 11 which is coaxial with but of slightly smaller diameter, than a conical portion 12, the diameter of which diminishes progressively from the collar 10 towards the coupler 11. The conical portion 12 constitutes, in this manner, the base wall of the annular chamber 6. The walls 9 extend up to the portion 12 and are solid (see FIG. 4); the lower end of each wall 9 is inclined in a manner to mate with the inner surface of the portion 12.

The cylindrical wall 7 is formed with a closed end section 13 of the head that remote from the receptacle 4. The wall 7 terminates at a certain distance d from the base of portion 12, this distance d corresponding to the imaginary extension of the cylindrical surface of the wall 7 towards the base of the wall 12.

The internal diameter of the coupler 11 is also the same diameter as the wall 7.

A cylindrical tube 14 is slidingly disposed in and relative to the central conduit 5 formed by the wall 7 on the interior of that conduit.

The tube 14 includes, towards its end intended to face towards the container 4, a plurality of openings 15 in its wall, regularly disposed about its periphery. The openings 15 are advantageously constituted by longitudinal slots which are opened on the lower end of the tube 14 which faces towards the container 4.

In a storage condition, as shown in FIG. 1, the tube 14 only engages a very small portion of the wall 7, sufficient in order that the engagement of the upper extremity of the tube 14 and the wall 7 assures a fluid tight seal or closing, whereas, in this position, the openings 15 do not communicate with the annular chamber 6 and are closed by the internal surface of the coupler 11. The annular chamber 6 is thus sealed off from the central conduit 5 by the space corresponding to the distance d, by the wall of the tube 14.

Figure 2:
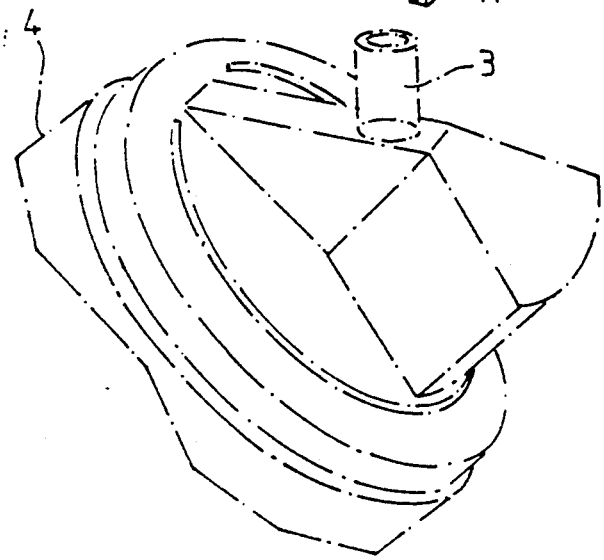
FIG. 2, the view similar to that of FIG. 1 of the dispensing head but mounted on a container.
Figure 2:
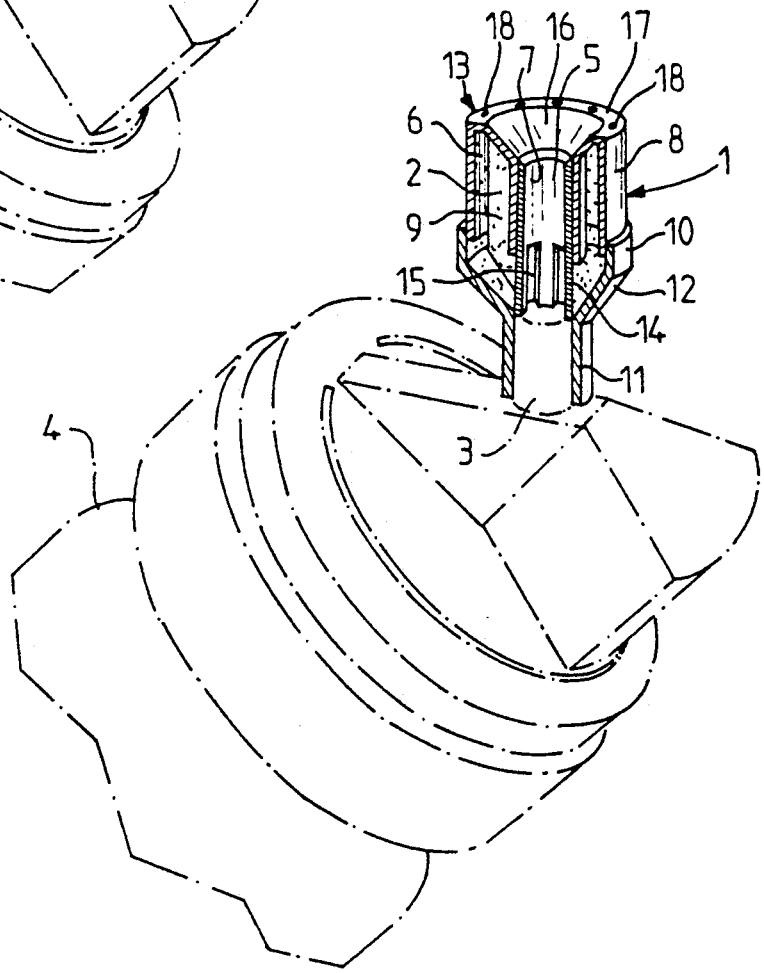
Figure 3:
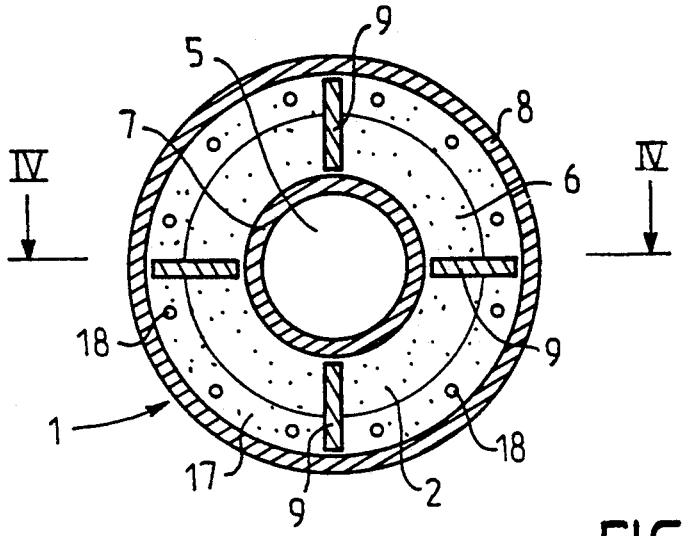
FIG. 3, is a sectional view along lines III—III of FIG. 4.

In a condition for use, represented by FIG. 2, the tube 14 has been pushed axially in the wall 7 by a distance sufficient to establish communication between the chamber 2 and the central conduit 5 through the openings 15.

The outlet 3 of the container is furnished with a nozzle of a cylindrical form having a diameter which is approximately equal to that of the tube 14; the coupler 11 is provided so as to engage with a frictional fit on the cylindrical nozzle of the outlet 3 so that the placing of the head 1 on the container 4 will cause the sliding of the tube 14 on the interior of the cylindrical wall 7 upon engaging the nozzle of the outlet 3.

The upper extremity of the central conduit 5 which opens towards the outside is extended by a conical portion 16 which flares outwardly from the side opposite the container 4 and will permit the foaming product provided in the container to expand before mixing with the additive, for example, a colorant agent, which avoids disturbing the formation of the streaks formed by the additive, as described below.

The conical portion 16 is provided at its outside extremity with a peripheral rim or crown 17 which closes the annular chamber 6. A plurality of opening passages 18, regularly spaced apart, are provided in the rim 17 and which constitute the outlet means for the additive.

The correspondence of the diameter of the central conduit 5 to sum of the diameters of the outlet openings 18 of the additive is chosen according to the desired length and size for the ribbons or striations formed in the dispensed product and according to the viscosity of the additive.

For storage, the dispensing head is closed by a thermo-film or heat shrunk cover on its extremity or end 13 and, on the other side, by the tube 14 which occupies the position as shown in FIG 1. It is possible for one to provide a second similar cover on the end of the coupler 11.

Use of the dispensing head will be evident from the foregoing description.

After having removed the cover for the end 13, and, if provided, the cover for the lower part of the coupler 11, one fits the coupler 11 on the nozzle of the outlet 3. This will drive the tube 14 along the conduit 5 as shown in FIG. 2. The annular chamber 6 will then be placed in communication through the openings 15 with the central conduit 5.

When one requires dispensing of the product contained in the container 4, one part of the product, in the form of a foam in the example under consideration, penetrates into the chamber 6 and forces the additive towards the exterior through the apertures 18. The another portion of the foam is dispensed directly through the central conduit 5.

The additive expelled across the openings 18 forms lines or striations on the emerging foam upon exiting from the central conduit 5.

The correspondence between the sum of the areas of the openings 15 relative to the transverse surface of the tube 14 defines the proportion of foam which penetrates into the chamber 6 and also the length of the striations on the emerging body of foam which exits from the conduit 5.

The dispensing head of the present invention can be particularly used with an additive product 2 where a principal product dispensed from the conduit 5 in the form of a foam. However, the head can equally be used to add an additive to a principal product which is dispensed in the form of a paste.

Having described the invention, it will be apparent to those skilled in the art that various modifications may be made thereto without departing the spirit and scope of this invention as defined in the appended claims.

What is claimed is:

1. A dispensing head for an additive with the head having means for attachment to an outlet of a container for a product of the type that is dispensed in the form of a foam or a paste, said head having first wall means defining a central conduit having at one end said means for attachment, second wall means disposed about said first wall means to define a chamber for the additive, aperture means for dispensing the additive from said chamber, said aperture means disposed on a top wall of said chamber opposite to said end of said conduit, said chamber having an opening in communication with said central conduit, tube means slidably disposed relative to said central conduit and movable between a storage position wherein said opening of said chamber is closed by said tube means, and another position, wherein said opening of said chamber is unobstructed.

2. The distribution head as claimed in claim 1, where said tube means is hollow tube having at one end slots formed therein which are movable with said tube from said storage position to said another position wherein said openings of said tube are adjacent said opening of said chamber to establish communication therethrough.

3. The dispensing head of claim 1 wherein said tube means is mounted to slide on an interior of said central conduit.

4. The dispensing head of claims 2 or 3 wherein said means for attachment comprises a cylindrical coupling member having an interior surface for closing the openings in said tube when said tube is in said storage position.

5. The dispensing head as claimed in claim 4 wherein said chamber has a conically shaped base wall and said coupling member is joined to the base of said base wall of said chamber.

6. The dispensing head as claimed in claim 2, wherein said openings in said tube are in the form of longitudinal slots which extend along said tube to one end thereof and are opened at said one end thereof.

7. The combination of a dispensing head as claimed in claim 1 and a container having an outlet, wherein said outlet of the container is of a type that is cylindrically shaped and wherein said coupling member of the dispensing head is shaped to frictionally engage a nozzle, said storage position of said tube means in said central conduit being adjacent said coupling member so that attachment of said dispensing head to said nozzle brings said nozzle into engagement with said one end of said tube means to induce sliding movement of said tube means in said central conduit from said storage position to said another position.

8. The dispensing head as claimed in claim 1, wherein said central conduit has a flared portion at said other end of said central conduit.

9. The dispensing head as claimed in claim 8, wherein said flared portion of said central conduit terminates in a rim portion peripherally surrounding said central conduit and closing said annular chamber, said rim portion having said aperture means for dispensing the additive product.

10. The dispensing head as claimed in claim 1, wherein radial partitions are provided in said chamber surrounding said central conduit.

11. The dispensing head as claimed in claim 9, wherein a covering member is provided for storage over said rim and a separate cover is provided over said coupling member.

12. A container for a product comprising one of a foam aerosol and a paste wherein said container has an outlet provided with a dispensing head as claimed in claims 1, 2 or 3.

* * * * *